United States Patent [19]

Waite et al.

[11] Patent Number: 4,478,469

[45] Date of Patent: Oct. 23, 1984

[54] CARD KEYING DEVICE

[75] Inventors: Robert J. Waite, Huntington Beach; Ronald P. Almeida, Yorba Linda, both of Calif.

[73] Assignee: Zero Corporation, Burbank, Calif.

[21] Appl. No.: 378,538

[22] Filed: May 17, 1982

[51] Int. Cl.[3] ..... H01R 13/64

[52] U.S. Cl. ..... 339/17 LC; 339/184 M; 339/186 M

[58] Field of Search ..... 339/176 M, 17 LC, 184 R, 339/184 M, 186 R, 186 M

[56] References Cited

U.S. PATENT DOCUMENTS

| | | | |
|---|---|---|---|
| 2,928,998 | 3/1960 | Brumfield | 339/186 M X |
| 3,054,078 | 9/1962 | Boshkin | 339/176 M X |
| 3,139,492 | 6/1964 | Cage, Jr. | 339/186 M X |
| 3,200,361 | 8/1965 | Schwartz et al. | 339/17 LC |
| 3,320,572 | 5/1967 | Schwartz | 339/176 M X |
| 3,447,036 | 5/1969 | Dore et al. | 317/99 |
| 3,818,280 | 6/1974 | Smith et al. | 339/184 M X |

FOREIGN PATENT DOCUMENTS

| | | | |
|---|---|---|---|
| 2455409 | 8/1976 | Fed. Rep. of Germany | 339/186 M |
| 2743033 | 3/1979 | Fed. Rep. of Germany | 339/186 M |

*Primary Examiner*—Z. R. Bilinsky

*Attorney, Agent, or Firm*—Harry R. Lubcke

[57] ABSTRACT

A male-female keying device formed of two elongated strips, one on each element that is to be keyed. Correspondingly positioned holes are in each strip. A few projecting male pins are located in selected holes in one strip and several non-projecting pins are located in each hole of the other strip *except* those holes that are positioned to receive the male projecting pins. A pair of spaced apart elongated pins act as guides in assembling the two strips.

A relatively large number of holes in both strips allows a very large number of codes to be arranged, whereby only one pair of male and female strips can be mated.

7 Claims, 6 Drawing Figures

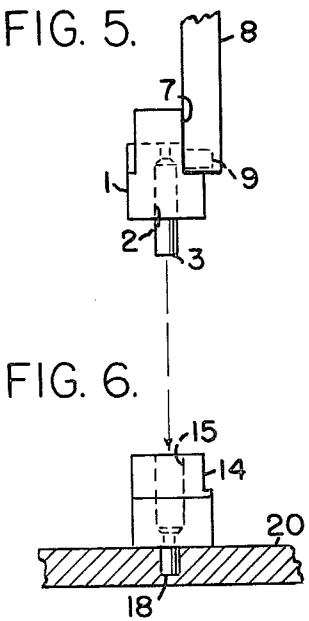
FIG. 5.
FIG. 6.
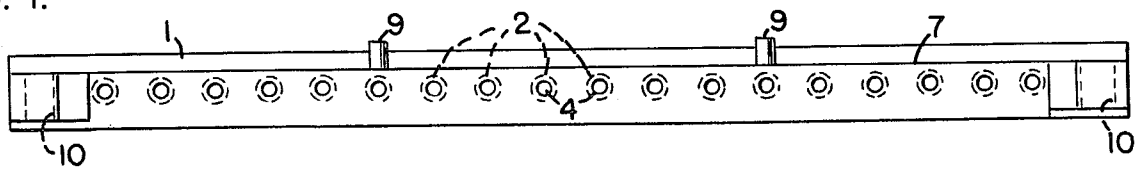
FIG. 1.
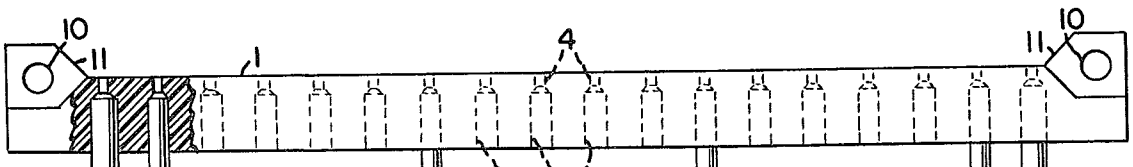
FIG. 2.
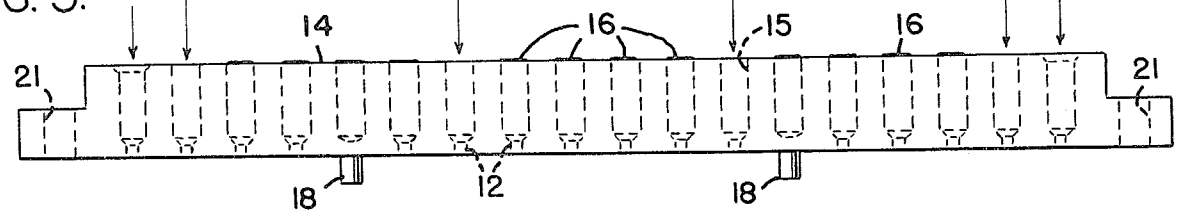
FIG. 3.
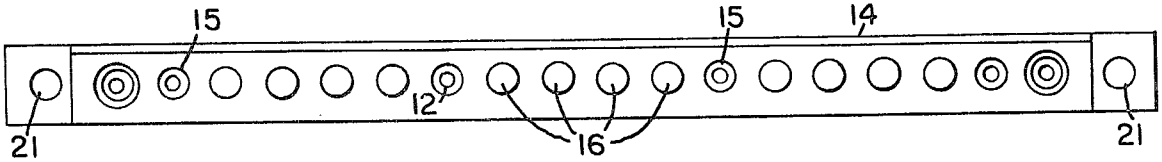
FIG. 4.

CARD KEYING DEVICE

BACKGROUND OF THE INVENTION

This invention pertains to uniquely keying two parts together amongst a plurality of such parts.

U.S Pat. No. 3,818,280 discloses a keying structure that is a part of a printed circuit board connector.

The lower edge of the circuit board has permanently cutout slots along the lower edge. A separate strip of circuit board material is removably locked within the connector so that such a strip can be chosen that corresponds with upstanding tabs that enter the slots in the circuit board.

The code of the circuit board cannot be changed, but the entry into another connector can be accomplished by moving the separate strip that corresponds to the slots in the circuit board to that other connector.

U.S. Pat. No. 3,447,036 discloses a keying assembly for mounting and aligning rectangular modules. Four square holes are provided into which a relatively thin rectangular male piece is oriented to one of four possible positions.

Female coding plugs are preadjusted to mate with only one of the sets of male coding plugs.

A maximum of 256 codes are available.

Other structural constraints are used to align the modules.

SUMMARY OF THE INVENTION

A male-female keying device for uniquely pairing circuit cards and a connector. The keying code can be altered. An elongated pin at each end of the device acts as a guide for ease in assembling the male and female parts.

A plurality of aligned holes is provided in both elongated strips of the device. Plural pins are inserted in selected holes of the male part, projecting from these holes. Plural short pins are inserted in all but the selected holes in the female part, being flush with the surface of the strip. Thus, only two parts with the same keying code can be fitted together.

A large variety of keying codes can be selected for different pairs of the male-female keying device.

If it is desired that any code be changed, this is accomplished by merely changing the hole positions of the male projecting pins and the female flush pins in the elongated strips.

Somewhat tapered extra length male pins are preferably employed at opposite ends of the strip to act as guides for mating the strips.

BRIEF DESCRIPTION OF THE DRAWINGS

FIG. 1 is a top plan view of the male part of the card keying device.

FIG. 2 is a side elevation view of the same.

FIG. 3 is a side elevation view of the female part of the card keying device.

FIG. 4 is a top plan view of the female part of the same.

FIG. 5 is an end view of the male part of the card keying device, showing a part of the circuit card.

FIG. 6 is an end view of the female part of the card keying device, showing a part of the housing.

DETAILED DESCRIPTION OF THE PREFERRED EMBODIMENTS

In FIGS. 1, 2 and 5, numberal 1 identifies a first elongated strip that forms the body of the male, typically upper, part of the card keying device.

A number of holes 2, such as a total of 16, are typically equally spaced along approximately the center line of the strip. As a matter of choice, these holes received a few keying pins 3, as shown.

A preferred material for the strip is glass-filled polycarbonate, and for the pins is metal, which is anodized or otherwise treated to be corrosion-proof.

The keying device may be made in any size. One typical size is smaller than that of the figures herein, which figures are about double full size for size for sake of clarity.

The length may be 10 centimeters (cm) and the thickness 0.6 cm. For such a size the pins are preferably 0.24 cm diameter by 0.65 cm long, so that about 0.2 cm projects beyond the surface of the strip.

The pins are made an easy force fit into corresponding holes in the strip that are 0.45 cm deep. The holes are continued through the strip at a reduced diameter 4 of 0.12 cm to allow removal of a pin by pushing it out with a small-diameter rod.

A farther-projecting pin 5 is preferably utilized in the last hole at each end of the strip. These are tapered and pointed over about one-third of the exposed length, which exposed length may be 0.5 cm. These pins first enter holes in the second elongated strip when the two are being put together, making assembly easy.

One-sided slot 7 is provided the length of the first elongated strip for the purpose of fitting the strip to an edge of a printed circuit card 8 that is shown fragmentarily in FIG. 5.

In addition, normally two cast-in alignment pins 9 project from the side of the strip having slot 7. These pins pass through holes that are provided in board 8, so that the board can be pushed onto the strip and firmly retained there. These dowel pins 9 may have a diameter of 0.24 cm and a projecting length of approximately 0.5 cm in the embodiment being considered.

Holes 10 in an elevated boss 11 at each end of strip 1 are provided to accept a bolt and nut, or an equivalent fastening, for securing the keying device to printed circuit card 8.

A desired keying code is implemented by the number of and the positions of pins 3. Typically, two or three pins are placed in the strip and protrude from selected holes in the group of 16 holes. The pins would normally be spaced apart along the row of holes.

One pin would accomplish coded keying, but a small plurality of spaced pins is to be preferred to provide redundancy. With 16 holes available and any combination of placing the pins therein being allowable, it is seen that a very large number of key codes are available; i.e., 3.360.

In FIG. 3, second elongated strip 14 is the female mate of first elongated strip 1 of FIG. 2. When suitably prepared only a strip 1 of a selected code is accepted.

Strip 14 is provided with the same number of holes 15 of the same diameter and the same spacing as holes 2 in strip 1. Thus, any pins 3 in place in strip 1 will be received in corresponding holes in strip 14.

The code is set by inserting flush pins 16 in holes 15 that are *not* to accept projecting pins 3 from first strip 1.

As shown in FIGS. 3 and 6, downwardly projecting alignment bosses 18 are molded in or inserted in the bottom surface of second strip 14. These enter corresponding holes in housing 20, which supports the strip, and act as dowel pins. Strip 14 is fastened to the housing by screws (not shown) that are passed through end holes 21.

While a preferred embodiment has been described, similar embodiments in which holes 2 and 15 are not evenly spaced along the lengths of the strips, in which the cross-sectional shapes of the strips may be modified, and in which the relative proportions of the elements may be varied, are according to the subject invention. Also, the positions of strips 1 and 14 may be changed with respect to circuit card 8 and housing 20

We claim:

1. A male-female keying device, comprising;

(a) a first elongated strip (1) having therein a plurality of wholly cylindrical holes therealong, (b) pins (3) removably but firmly fitted into selected said holes in only said first elongated strip according to a selected position code, said pins projecting from said holes, (c) a pair of pins (5) fitted into substantially the extremities of said first strip and projecting farther from said strip than the removable pins, said pair of pins tapered to act as guides in assembling the device, (d) a second elongated strip (14) having a plurality of wholly cylindrical holes (15) therealong that match the positions of said plurality of holes and accept with sliding fit the pins (3) fitted into said selected holes and said pair of pins (5) in said first strip, and (e) flush-fitting pins (16) in all such holes in said second strip as are not provided with projecting pins according to the selected code of said first strip upon assembly of said device whereby only said first and second elongated strips that have the same code can be fitted together.

2. The keying device of claim 1, in which;

(a) each of said plurality of holes (2) along said first elongated strip (1) additionally includes continued holes (4) of reduced diameter through said strip.

3. The keying device of claim 1, in which;

(a) each of said plurality of holes (15) along said second elongated strip (14) additionally includes continued holes (12) of reduced diameter through said strip.

4. The keying device of claim 1, which additionally includes;

(a) a one-sided slot (7) along a side of said first elongated strip (1) to exclusively allow fitting said strip to the edge of a circuit card (8).

5. The keying device of claim 1, which additionally includes;

(a) plural spaced alignment pins (9) disposed upon a side of said first elongated strip to fit into holes in a circuit card (8) to which said first elongated strip is attached.

6. The keying device of claim 1, which additionally includes;

(a) plural spaced alignment bosses (18) disposed upon the bottom of said second elongated strip to fit into holes in a housing (20) to which said second elongated strip is attached.

7. The keying device of claim 1, which additionally includes;

(a) an elevated boss (11) having a hole (10) at each end of said first elongated strip (1) to secure said strip to a circuit card (8).

* * * * *